US009399343B2

(12) United States Patent
Kuroda

(10) Patent No.: US 9,399,343 B2
(45) Date of Patent: Jul. 26, 2016

(54) CONTROL METHOD FOR AN INKJET PRINTER, AND AN INKJET PRINTER

(71) Applicant: Seiko Epson Corporation, Tokyo (JP)

(72) Inventor: Kiyomi Kuroda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/522,492

(22) Filed: Oct. 23, 2014

(65) Prior Publication Data

US 2015/0109366 A1 Apr. 23, 2015

Related U.S. Application Data

(62) Division of application No. 13/005,491, filed on Jan. 12, 2011.

(30) Foreign Application Priority Data

Jan. 14, 2010 (JP) ..... 2010-005664

(51) Int. Cl.
*B41J 2/165* (2006.01)

(52) U.S. Cl.
CPC ..... *B41J 2/16505* (2013.01); *B41J 2/1652* (2013.01); *B41J 2/16508* (2013.01)

(58) Field of Classification Search
None
See application file for complete search history.

(56) References Cited

U.S. PATENT DOCUMENTS

| | | | | |
|---|---|---|---|---|
| 5,726,692 | A * | 3/1998 | Yamaguchi et al. | 347/23 |
| 5,864,349 | A | 1/1999 | Hirabayashi et al. | |
| 6,050,671 | A | 4/2000 | Rotering | |
| 6,299,277 | B1 | 10/2001 | Fujii | |
| 2001/0012028 | A1 | 8/2001 | Nitta | |
| 2008/0291240 | A1 * | 11/2008 | Ohsako et al. | 347/33 |
| 2011/0102503 | A1 | 5/2011 | Inomata | |

FOREIGN PATENT DOCUMENTS

| | | | |
|---|---|---|---|
| CN | 102069644 | A | 5/2011 |
| JP | 07-025026 | A | 1/1995 |
| JP | 10-146993 | A | 6/1998 |
| JP | 10-230614 | A | 9/1998 |
| JP | 2000-006436 | A | 1/2000 |
| JP | 2000-108376 | A | 4/2000 |
| JP | 2008-149510 | A | 7/2008 |
| JP | 2010-000780 | A | 1/2010 |

OTHER PUBLICATIONS

Non-Final Office Action, dated Nov. 7, 2012, of related U.S. Appl. No. 13/005,491.
Final Office Action, dated Feb. 27, 2013, of related U.S. Appl. No. 13/005,491.
Non-Final Office Action, dated Jul. 24, 2014, of related U.S. Appl. No. 13/005,491.

* cited by examiner

*Primary Examiner* — Alejandro Valencia
(74) *Attorney, Agent, or Firm* — Kilpatrick Townsend & Stockton LLP

(57) ABSTRACT

An inkjet printer can desirably clean two inkjet heads mounted on a head carriage before printing starts. The inkjet printer 1 has first and second inkjet heads 13A and 13B mounted on a head carriage 14. Before printing starts, the inkjet printer moves the head carriage 14 from a home position HP to a shift position SP so that the second inkjet head 13B, which is closest to the home position HP, is opposite a maintenance head cap 22 with an ink absorption capability and cleans the inkjet head. The head carriage 14 is then returned to the home position HP so that the first inkjet head 13A is opposite the maintenance head cap 22 and cleans the inkjet head. The head carriage 14 then moves to the printing area C side and printing starts.

1 Claim, 6 Drawing Sheets

CONTROL METHOD FOR AN INKJET PRINTER, AND AN INKJET PRINTER

This application is a divisional of U.S. application Ser. No. 13/005,491, filed Jan. 12, 2011, which claims priority to Japanese Patent Application No. 2010-005664, filed Jan. 14, 2010, the entire disclosures of which are incorporated by reference herein.

BACKGROUND

1. Technical Field

The present invention relates to an inkjet printer and to a control method for an inkjet printer that executes a cleaning process to discharge ink droplets from the nozzles of plural inkjet heads that are carried on a head carriage in order to prevent the plural nozzles of the inkjet head from clogging.

2. Related Art

The nozzles of an inkjet head used in an inkjet printer can become clogged as a result of an increase in the viscosity of ink left inside the nozzles, resulting in the clogged nozzles being unable to discharge a sufficient volume of ink. If printing is attempted using an inkjet head in which some nozzles are clogged, dots may be dropped or poorly formed and print quality drops accordingly. Inkjet printers therefore regularly or at specified times move the carriage that carries the inkjet head to a home position removed from the printing area so that the nozzle surface of the inkjet head is opposite a head cap with an ink sponge used for maintenance, and then discharge a specific amount of ink from each of the nozzles to flush (clean) the nozzles.

Japanese Unexamined Patent Appl. Pub. JP-A-H10-146993 teaches a flushing control method for an inkjet printer. The flushing control method taught in JP-A-H10-146993 counts how long (the time) the maintenance head cap caps the inkjet head while the carriage is stopped in the home position, and flushes the nozzles regularly based on the elapsed time.

In the case of such an inkjet printer with plural inkjet heads, the printer also has the same number of maintenance head caps as inkjet heads. An ink sponge and a suction mechanism for vacuuming ink from each of the nozzles is disposed for each of the maintenance head caps. The suction mechanism therefore requires more suction channels than when there is only one maintenance head cap, and size and cost both increase because a motor with a strong suction force must be provided.

A single maintenance head cap that can cap the nozzle surface of one inkjet head at a time could conceivably be used, and the inkjet heads could be sequentially positioned opposite the maintenance head cap for flushing or other head maintenance operation. If the inkjet heads are not flushed in the appropriate order before printing starts in this configuration, wasted motion is created in the movement of the head carriage. More specifically, the start of printing will be delayed if the inkjet head is not appropriately flushed before printing starts, and printer throughput will drop.

SUMMARY

An inkjet printer control method and an inkjet printer according to the invention enable efficiently cleaning plural inkjet heads mounted on a head carriage without delaying the start of printing.

A first aspect of the invention is a control method for an inkjet printer that moves a head group including inkjet heads 1 to n (where n is an integer of two or more) reciprocally in the direction in which the inkjet heads are arrayed to print in a printing area, cleans by discharging ink droplets from each of the inkjet heads 1 to n, and has a maintenance head cap with an ink absorbance capability disposed to a position opposite a first inkjet head, which is the inkjet head that is on the printing area side when the group of inkjet heads 1 to n is at a home position removed from the printing area, the control method including steps of: moving the inkjet heads 1 to n toward the printing area; positioning inkjet head n located on the home position side opposite the maintenance head cap and cleaning inkjet head n; and thereafter sequentially moving the inkjet heads to the position opposite the maintenance head cap and cleaning the heads in sequence from inkjet head (n−1) to inkjet head 1.

This aspect of the invention cleans plural inkjet heads sequentially from the n-th inkjet head, which is on the home position side end of the row of inkjet heads, before printing starts, and returns the inkjet heads 1 to n to the same positions as when waiting at the home position. Therefore, after cleaning the inkjet heads is finished, the inkjet heads 1 to n can be immediately moved to the printing area and printing can start.

Another aspect of the invention is an inkjet printer including: a head unit including inkjet heads 1 to n (where n is an integer of two or more); a head carriage on which the head unit is mounted; a carriage drive mechanism that moves the head carriage from the home position passed the printing area along a carriage path in the direction in which the inkjet heads 1 to n are arrayed; a maintenance head cap that has an ink absorbance capability disposed to a position opposite the nozzle surface of a first inkjet head, which is the inkjet head located on the home position side when the group of inkjet heads 1 to n is at the home position; and a cleaning control unit that before printing starts sequentially sets each of the inkjet heads 1 to n opposite the maintenance head cap, discharges ink droplets, and cleans the inkjet heads. The cleaning control unit moves the head carriage toward the printing area, positions the nozzle surface of the inkjet head n located on the home position side opposite the maintenance head cap and cleans inkjet head n, and thereafter sequentially moves the nozzle surface of each of the inkjet heads to the position opposite the maintenance head cap and cleaning the heads in sequence from inkjet head (n−1) to inkjet head 1.

When the invention is applied to an inkjet printer that has first and second inkjet heads, a head unit with a first inkjet head and an adjacently disposed second inkjet head; a head carriage on which the head unit is mounted; a carriage drive mechanism that moves the head unit from the home position passed the printing area along a carriage path in the direction in which the first and second inkjet heads are arrayed; a maintenance head cap that has an ink absorbance capability disposed to a position opposite the nozzle surface of the first inkjet head at the home position; and a cleaning control unit that before printing starts sequentially sets each of the first and second inkjet heads opposite the maintenance head cap, discharges ink droplets, and cleans the inkjet heads. The cleaning control unit moves the head carriage toward the printing area, positions the nozzle surface of the second inkjet head opposite the maintenance head cap and cleans the second inkjet head, and then returns the head carriage to the home position, positions the nozzle surface of the first inkjet head opposite the maintenance head cap and cleans the first inkjet head.

Preferably, the inkjet printer also has a moisture retention head cap disposed at a position opposite the nozzle surface of the second inkjet head at the home position to prevent an increase in the viscosity of ink inside the nozzles of the second inkjet head.

EFFECT OF THE INVENTION

The invention cleans plural inkjet heads sequentially from the n-th inkjet head, which is on the home position side end of the row of inkjet heads, before printing starts, and returns the inkjet heads 1 to n to the same positions as when waiting at the home position. As a result, there is no need to move the inkjet head in the direction away from the printing area after cleaning the inkjet heads is finished, and then reverse direction and move the inkjet head back to the printing area for printing, and the inkjet heads 1 to n can therefore be immediately moved to the printing area and printing can start. A plurality of inkjet heads can thus be cleaned efficiently before printing starts using a maintenance head cap disposed in one location without delaying the start of printing.

Other objects and attainments together with a fuller understanding of the invention will become apparent and appreciated by referring to the following description and claims taken in conjunction with the accompanying drawings.

DESCRIPTION OF EMBODIMENTS

An inkjet printer according to a preferred embodiment of the invention is described below with reference to the accompanying figures.

General Configuration of an Inkjet Printer

Figure 1:
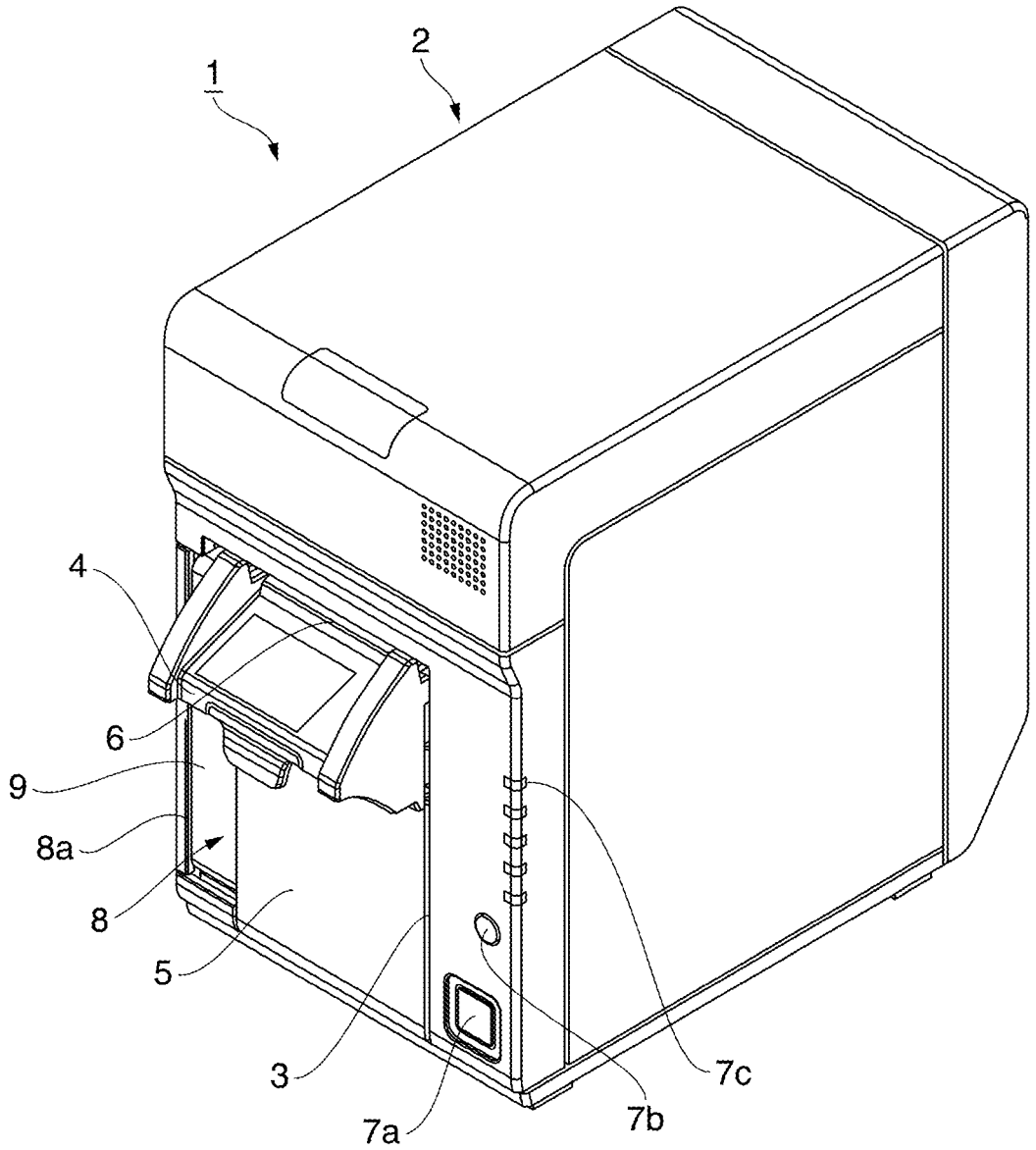
FIG. 1 is an external oblique view of an inkjet printer according to the invention.

FIG. 1 is an external oblique view of an inkjet printer. The inkjet printer 1 prints in color on a continuous web of recording paper delivered from a paper roll using plural different colors of ink, and has a generally box-shaped printer case 2 with an opening 3 for loading roll paper formed in the front center part of the printer case 2. The opening 3 is closed by an access cover 5 to which a recording paper discharge guide 4 is disposed at the top. A recording paper exit 6 is formed between the recording paper discharge guide 4 and the top edge part of the opening 3 in the printer case 2. When a lock mechanism not shown is released and the recording paper discharge guide 4 is pulled forward by hand, the access cover 5 can pivot forward at the bottom end thereof from the closed position shown in the figure to an open position.

A power switch 7*a*, paper feed switch 7*b*, and a plurality of operating status indicators 7*c* are arrayed at the right side of the access cover 5 at the front of the printer case 2. A loading opening 8*a* for an ink cartridge loading unit 8 that is rectangular in section and is disposed with the long side extending in the front-back direction of the printer is formed in the front of the printer case 2 on the left side of the access cover 5, and an ink cartridge 9 is loaded in this ink cartridge loading unit 8. When a button not shown is operated, the lock is released, the ink cartridge 9 is pushed forward by the force of a spring, and the ink cartridge 9 can be removed.

Figure 2:
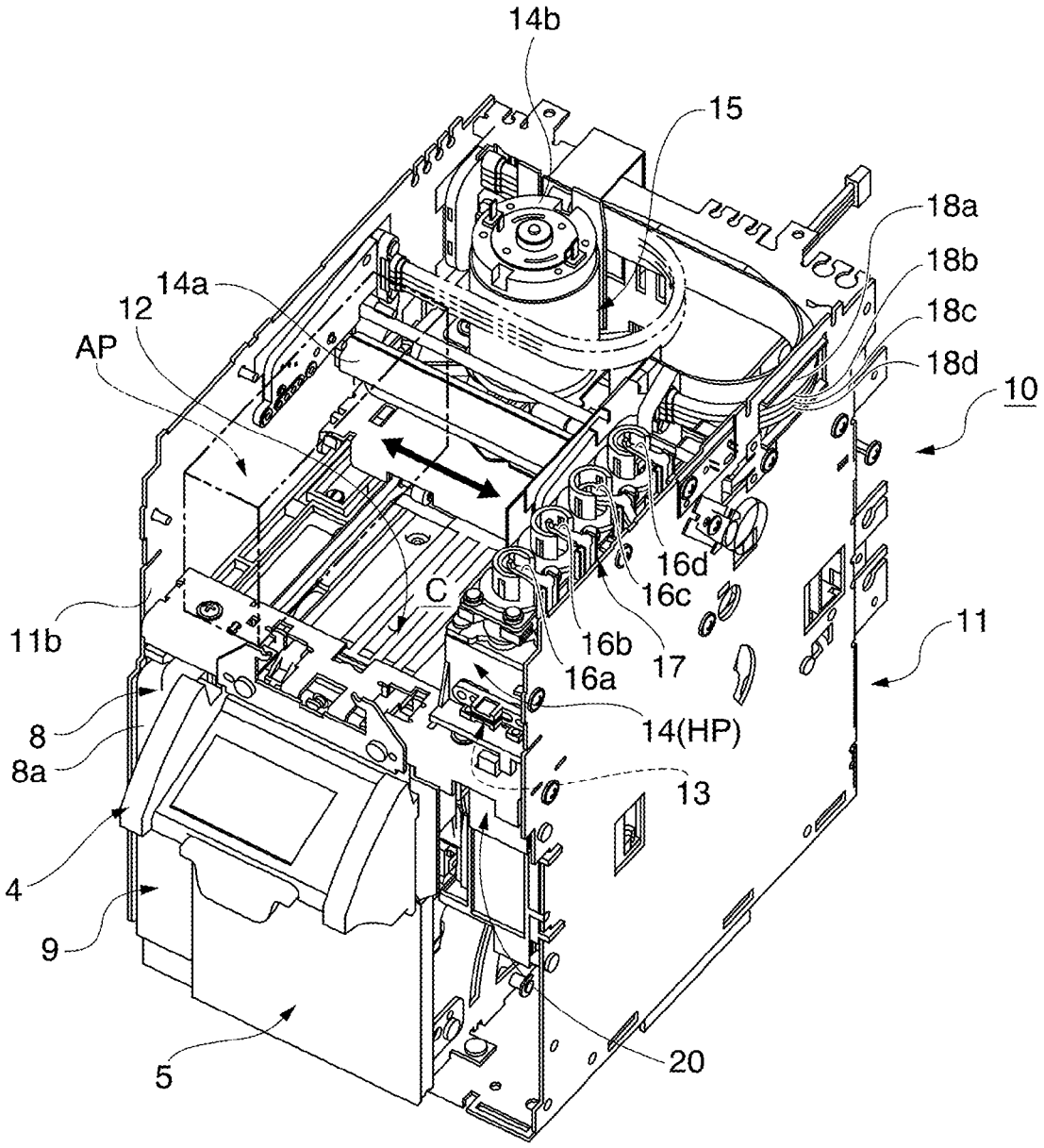
FIG. 2 is a schematic oblique view of the printer mechanism.
Figure 3:
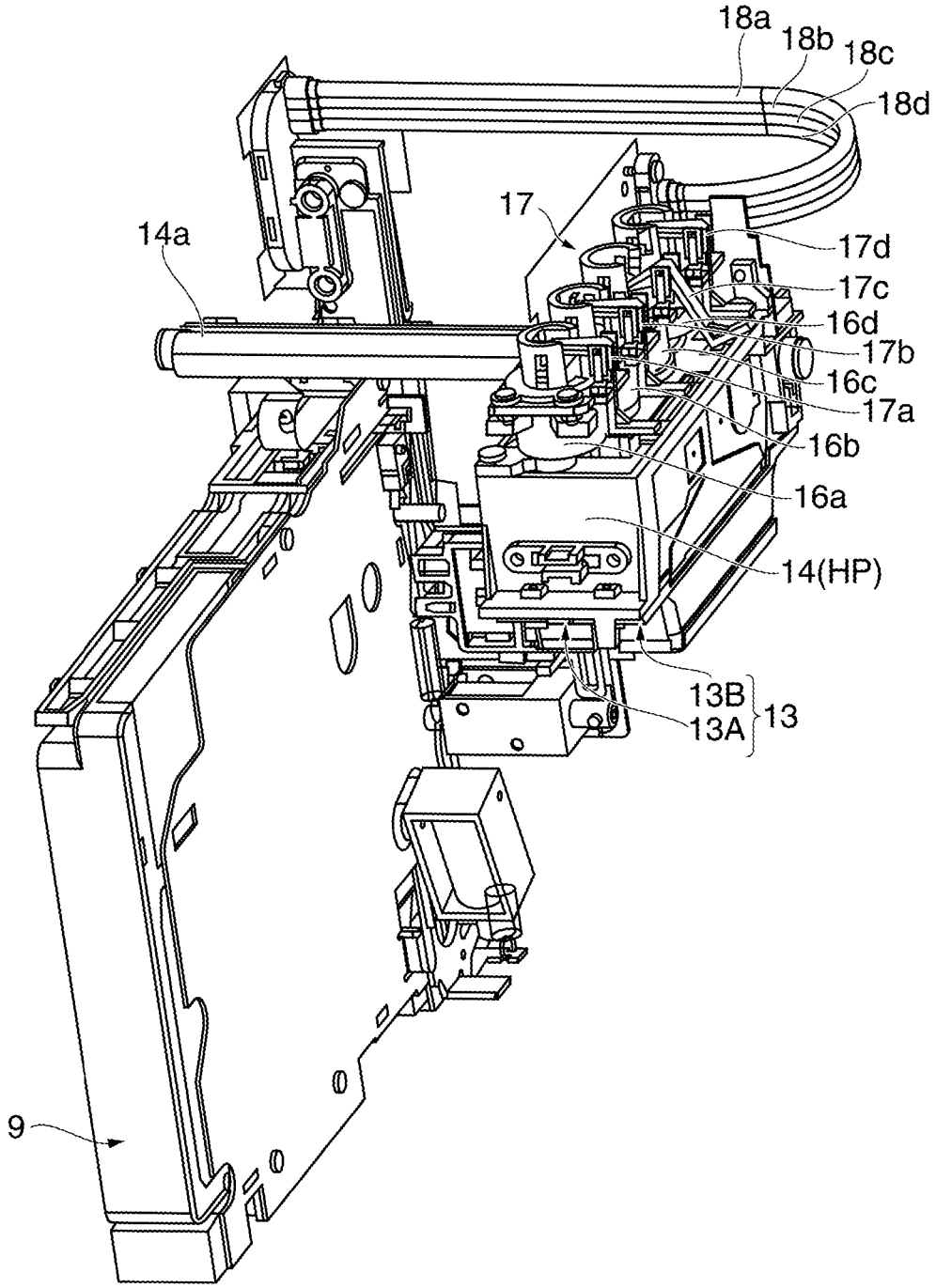
FIG. 3 schematically describes the ink supply path of the inkjet printer.

FIG. 2 is an oblique view of the print mechanism unit that is covered by the inkjet printer case. FIG. 3 schematically describes the configuration of the ink supply system of the inkjet printer.

As shown in the figure, a roll paper storage compartment is formed inside the print mechanism unit 10 in the center, and when the access cover 5 opens, this roll paper storage compartment opens to the front and the roll paper can be replaced, for example. A platen 12 that determines the printing area C extends widthwise to the printer above the roll paper storage compartment.

A head carriage 14 on which an inkjet head 13 is mounted with the nozzle surface facing down is disposed above the platen 12. A carriage guide shaft 14*a* extends parallel to the platen 12 widthwise to the printer behind the carriage 14, and a carriage motor 14*b* is located behind the carriage guide shaft 14*a*. The carriage motor 14*b* is the drive power source of the carriage drive mechanism 15, which moves the head carriage 14 bidirectionally in the head carriage scanning direction along the carriage guide shaft. The head carriage 14 is moved bidirectionally between a home position HP (the position indicated by a solid line in FIG. 2) that is removed to the right from the printing area C of the platen 12 by the carriage drive mechanism 15, and an away position AP (the position indicated by the imaginary line in FIG. 2) removed to the left side of the platen 12.

FIG. 3 shows the parts that render the ink supply system of the inkjet printer 1. As shown in the figure, the inkjet head 13 has a first inkjet head 13A and a second inkjet head 13B, which are mounted on the head carriage 14 at adjacent positions in the carriage scanning direction. As will be understood from FIG. 2 and FIG. 3, when the head carriage 14 is in the home position HP, the first and second inkjet heads 13A and 13B are both at a position separated to the right from printing area C defined by the platen 12. The first inkjet head 13A is positioned on the side toward the printing area C, and the second inkjet head 13B is positioned on the right widthwise to the printer.

When the head carriage 14 is set to the home position HP, the nozzle surface 13*a* of the first inkjet head 13A is set to the cleaning position. The maintenance head cap 22 of the head maintenance unit 20 described below is disposed to the cleaning position. The moisture retention head cap 23 of the head maintenance unit 20 is also disposed opposite the nozzle surface 13*b* of the second inkjet head 13B at this time.

A diaphragm pump unit 17 is disposed to the head carriage 14. The diaphragm pump unit 17 has subtanks 16*a* to 16*d* in which four colors of ink, cyan, magenta, yellow, and black, are stored.

As shown in FIG. 3, the diaphragm pump unit 17 has suction levers 17*a* to 17*d* attached to the top part of the subtanks 16*a* to 16*d* so that the levers can rock. One end of each suction lever 17*a* to 17*d* is disposed on the home position HP side of the diaphragm pump unit 17, and the other end is linked by a spring to the diaphragm of each subtank 16*a* to 16*d*.

When the head carriage 14 returns to the home position HP, one end of each suction lever 17*a* to 17*d* is pushed by the inside wall of the printer case 2, causing the suction lever 17*a* to 17*d* to rock, thereby operating the diaphragm connected to the other end of the suction lever 17*a* to 17*d* and producing negative pressure in the subtanks 16*a* to 16*d* Ink is pulled from the flexible ink tube 18*a* to 18*d* side into each subtank by this negative pressure. The ink stored in each subtank 16*a* to 16*d* is supplied to the ink paths inside the first and second inkjet heads 13A and 13B.

One end of each flexible ink tube 18*a* to 18*d* is connected to a corresponding subtank 16*a* to 16*d*, and the other end of each flexible ink tube 18*a* to 18*d* is connected to one of the four ink supply paths (not shown in the figure) that extend vertically at a position on the back side of the ink cartridge loading unit 8. The ink supply paths communicate with a corresponding ink cartridge 9 loaded in the ink cartridge loading unit 8.

When print data is received, the inkjet printer 1 advances the recording paper delivered from a paper roll by a recording paper transportation mechanism not shown over the surface of the platen 12 while the head carriage 14 scans synchronized to transportation of the recording paper and ink is discharged from the inkjet head 13 onto the recording paper to print on the recording paper.

Head Maintenance Unit

Figure 4:
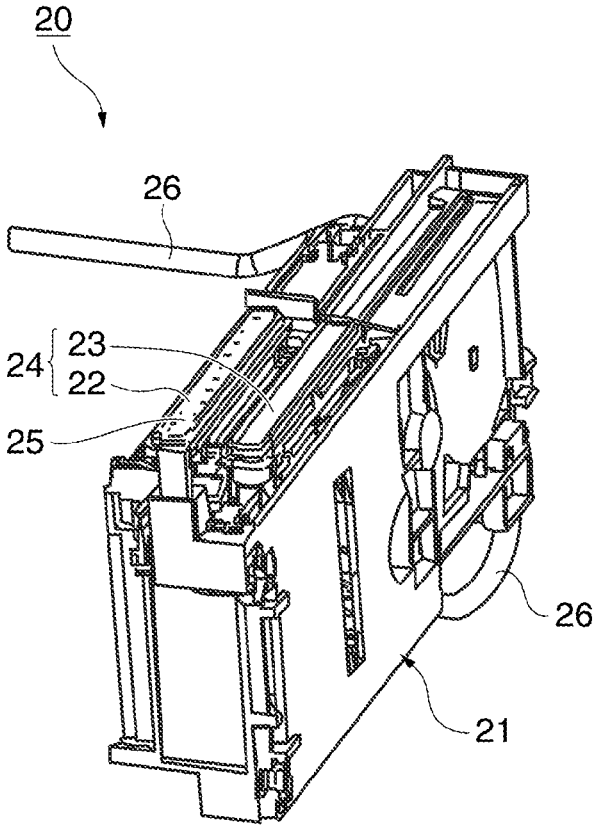
FIG. 4 is an oblique view of the head maintenance unit.

FIG. 4 is an oblique view of the head maintenance unit. The head maintenance unit 20 is disposed at a position below the home position HP, and has a unit case 21 with a narrow rectangular shape that is long in the front-back direction of the printer. A head cap unit 24 including the maintenance head cap 22 and moisture retention head cap 23 is disposed at the front top part of this unit case 21.

The maintenance head cap 22 and moisture retention head cap 23 are disposed adjacent to each other widthwise to the printer, that is, in the head carriage 14 scanning direction, and are open to the top. As described above, when the head carriage 14 is at the home position HP, the nozzle surface 13*a* of the first inkjet head 13A is opposite the maintenance head cap 22, and the nozzle surface 13*b* of the second inkjet head 13B is opposite the moisture retention head cap 23. A head cap lift mechanism not shown that raises and lowers the head caps in unison is assembled below the head cap unit 24. A tube pump and a tube pump drive motor not shown are assembled at a position behind the unit case 21.

The maintenance head cap 22 is rectangular in section and is open to the top. The ink sponge 25 is placed in the bottom of this cap and can absorb ink. A tube pump and waste ink tube 26 are connected to the maintenance head cap 22.

One of the inkjet heads can be set opposite the maintenance head cap 22 and flushed. Flushing is a cleaning operation that discharges ink droplets from the nozzles. The discharged ink droplets are held in the ink sponge 25. The ink held in the ink sponge 25 can be recovered by the tube pump through the waste ink tube 26. By driving the tube pump while the maintenance head cap 22 covers the nozzle surface of the inkjet head, a cleaning operation that suctions and discharges ink from the nozzles of the inkjet head can also be accomplished.

The moisture retention head cap 23 is also a rectangular cap that is open to the top, but does not have an ink sponge inside and is not connected to the tube pump or waste ink tube 26. The moisture retention head cap 23 is lifted by the head cap lift mechanism when the head carriage 14 is in the home position HP, and caps the nozzle surface 13*b* of the second inkjet head 13B. As a result, the nozzle surface 13*b* is held in a sealed, wet state.

Control System

Figure 5:
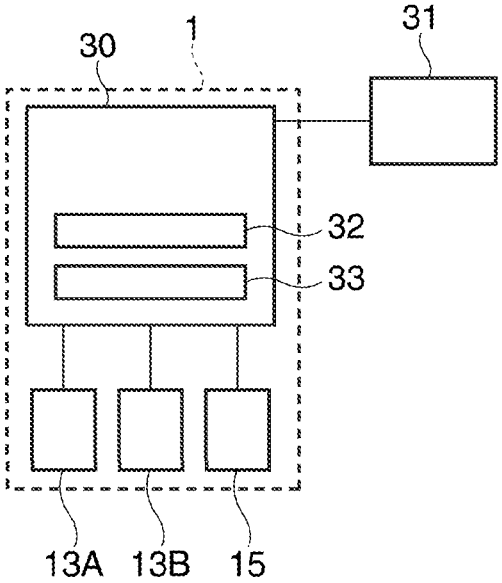
FIG. 5 is a block diagram showing the control system of the inkjet printer.

FIG. 5 is a block diagram showing the control system of the inkjet printer. The control system of the inkjet printer 1 is built around a control unit 30 that includes a CPU, ROM, and RAM. The control unit 30 is connected to a host device 31, for example, and controls other parts of the inkjet printer 1 based on print data and commands received from the host device 31.

Based on the received print data, the control unit 30 conveys the recording paper delivered from a paper roll over the surface of the platen 12, drives the carriage drive mechanism 15, and discharges ink from the inkjet heads 13A, 13B onto the recording paper while the head carriage 14 scans the paper to print. When printing ends, the control unit 30 moves the head carriage 14 to the home position HP so that the first inkjet head 13A waits at a position opposite the maintenance head cap 22. The control unit 30 also caps the first inkjet head 13A and the second inkjet head 13B with the maintenance head cap 22 and moisture retention head cap 23, respectively, while the head carriage 14 waits at the home position HP.

The control unit 30 includes a cleaning control unit 32. The cleaning control unit 32 executes a cleaning operation, that is, controls flushing, before printing starts. When print data is received and before starting to print the print data, the cleaning control unit 32 moves the head carriage 14 a specific distance towards the printing area C and disposes the nozzle surface 13*b* of the second inkjet head 13B opposite the maintenance head cap 22, and then flushes the second inkjet head 13B. The cleaning control unit 32 then returns the head carriage 14 and sets the nozzle surface 13*a* of the first inkjet head 13A opposite the maintenance head cap 22, and flushes the first inkjet head 13A. The cleaning control unit 32 then moves the head carriage 14 to the printing area C side, and moves the first and second inkjet heads 13A and 13B to the printing start position.

The control unit 30 also has an elapsed time monitoring unit 33.

While the head carriage 14 is stopped at the home position HP, the elapsed time monitoring unit 33 counts how much time has passed since the second inkjet head 13B was last flushed, and determines if this elapsed time exceeds a predetermined reference time.

If the elapsed time monitoring unit 33 detects that the elapsed time exceeds this predetermined reference time, the cleaning control unit 32 moves the head carriage 14 from the home position HP to the printing area C side, stops the head carriage 14 with the second inkjet head 13B positioned opposite the maintenance head cap 22, then flushes the second inkjet head 13B, and after flushing controls returning the head carriage 14 to the home position HP.

Flushing Operation

Figure 6:
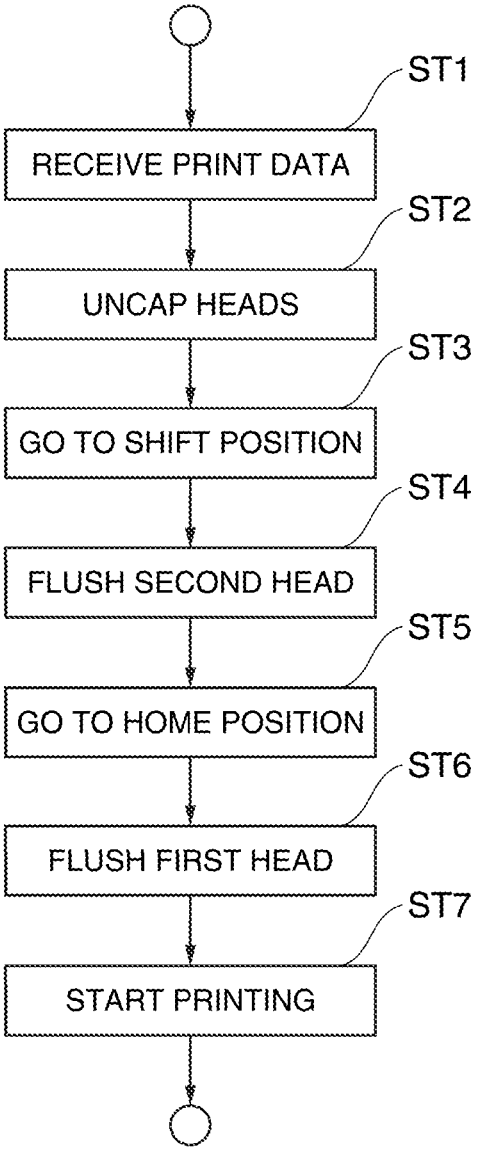
FIG. 6 is a flow chart describing the inkjet head flushing operation before printing starts.

FIG. 6 is a flow chart describing the flushing operation of the first inkjet head 13A and second inkjet head 13B executed when print data is received. FIG. 7 describes the flushing operation, and shows the relative positions of the inkjet heads (13A, 13B), the maintenance head cap 22, and the moisture retention head cap 23 as seen from the front of the printer during the flushing operation.

Figures 7A, 7B, 7C, 7D, 7E:
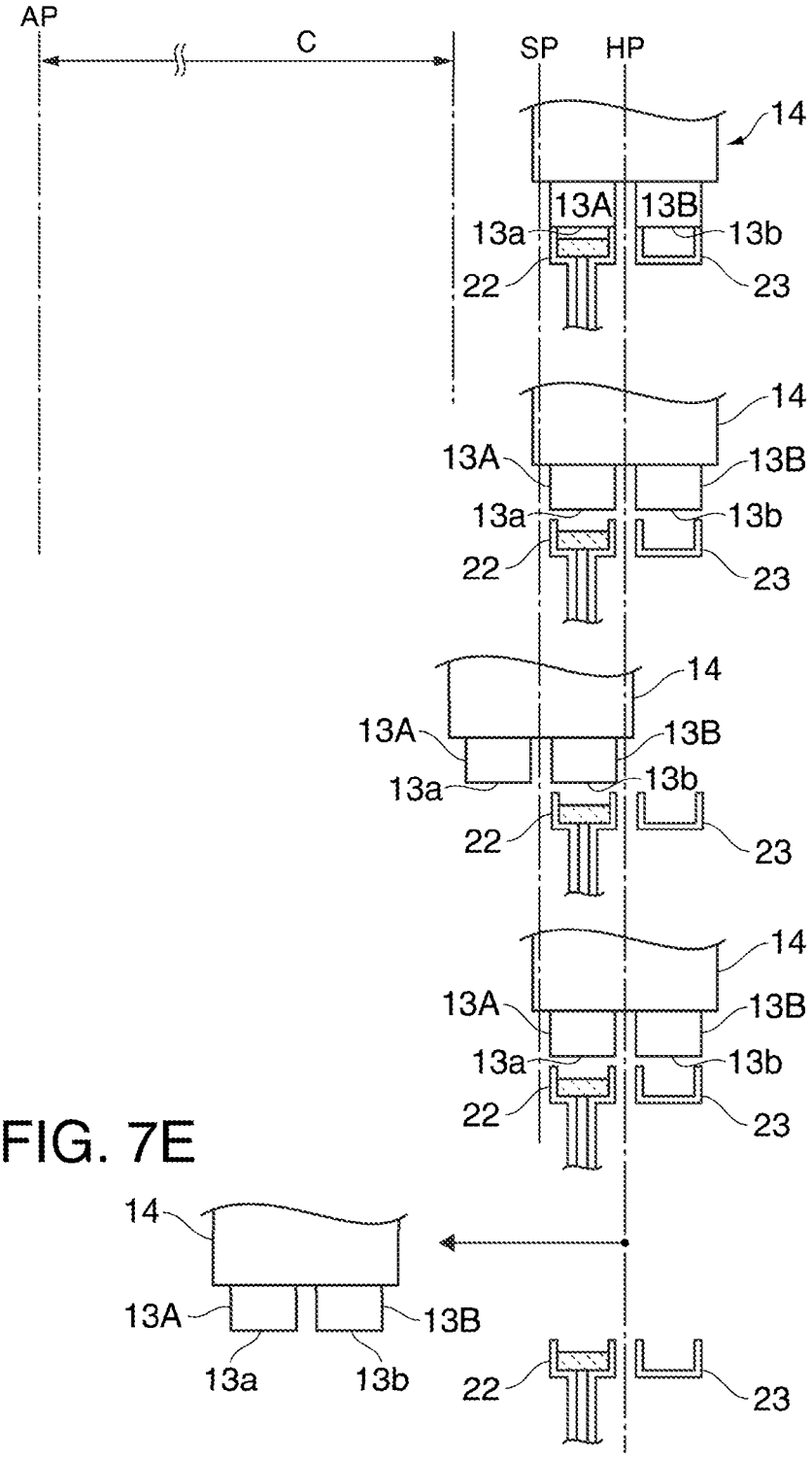
FIGS. 7A-7E describe the relative positions of various parts during the flushing operation shown in FIG. 6.

As shown in these figures, while waiting to receive print data, the head carriage 14 is in the home position HP as shown in FIG. 7A. When the head carriage 14 is in the home position HP, the maintenance head cap 22 and moisture retention head cap 23 are raised to the capping position by the head cap lift mechanism, and respectively cap the first inkjet head 13A and second inkjet head 13B.

When print data is received (step ST1 in FIG. 6), the cleaning control unit 32 lowers the maintenance head cap 22 by means of the head cap lift mechanism, and uncaps the first and second inkjet heads 13A and 13B (step ST2 in FIG. 6, and FIG. 7B). The head carriage 14 then moves from the home position HP to a shift position SP on the printing area C side (step ST3 in FIG. 6, and FIG. 7C). As a result, the nozzle surface 13*b* of the second inkjet head 13B is opposite the maintenance head cap 22.

The second inkjet head 13B is then flushed (step ST4 in FIG. 6). After flushing, the head carriage 14 is returned to the home position HP again so that the nozzle surface 13*a* of the first inkjet head 13A is opposite the maintenance head cap 22 (step ST5 in FIG. 6, FIG. 7D). The first inkjet head 13A is then flushed (step ST6 in FIG. 6).

Printing the print data starts after this flushing operation is completed (step ST7 in FIG. 6, FIG. 7E). More specifically, the control unit 30 prints on the recording paper by conveying the recording paper along the platen 12 while moving the head carriage 14 bidirectionally widthwise to the paper and discharging ink from the first and second inkjet heads 13A and 13B onto the recording paper synchronized to conveying the recording paper.

As described above, the second inkjet head 13B, which is on the home position HP side of the first inkjet head 13A, is flushed before the first inkjet head 13A, which is positioned on the printing area C side, before printing starts. When flushing is completed, the first and second inkjet heads 13A and 13B stop at the home position HP, which is the standby position. As a result, the head carriage 14 can be moved from this position toward the printing area C to start printing.

If the first inkjet head 13A is flushed first, the first inkjet head 13A will be at the shift position SP offset to the printing area C side from the flushing position when the second inkjet head 13B is flushed. Because the first inkjet head 13A is positioned in the printing area C when in this shift position SP, the head carriage 14 must first be returned to the home position HP before the printing operation starts. More specifically, after returning the head carriage 14 to the home position HP, the direction of head carriage 14 movement must be reversed and the head carriage 14 then accelerated to a specific speed to start printing, and there is therefore a delay until printing starts.

However, by flushing from the second inkjet head 13B side as described in this embodiment of the invention, there is no need to reverse the direction of head carriage 14 movement, the start of printing is not delayed, and printer throughput can be improved.

Other Embodiments

An inkjet printer having first and second inkjet heads is described in the foregoing embodiment of the invention. The invention is not so limited, however, and can also be applied to a printer having three or more inkjet heads. For example, when the printer has three inkjet heads, the maintenance head cap is disposed to a position opposite the first inkjet head, which is on the end closest to the printing area, and the heads are flushed sequentially from the third inkjet head, which is on the end on the home position side, before printing starts. This configuration may also have two moisture retention head caps to cap the nozzle surfaces of the second and third inkjet heads.

Note, further, that the foregoing embodiment uses flushing as an example of a cleaning operation, but the invention is not so limited. For example, a vacuum cleaning operation in which ink is suctioned from the nozzles of plural inkjet heads can also efficiently clean each of the inkjet heads when performed in the order described above.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A cleaning control method for an inkjet printer that prints in a printing area, the inkjet printer comprising a head unit comprising a first inkjet head and an adjacently disposed second inkjet head, the inkjet printer printing by moving the head unit reciprocally in a direction in which the inkjet heads are arrayed, the inkjet printer further comprising a maintenance head cap with an ink absorbance capability, the cleaning control method comprising:

from a home position of the head unit of the inkjet printer, at which the first inkjet head is the inkjet head that is closest to the printing area, and at which the maintenance head cap is disposed opposite the first inkjet head, moving the head unit from the home position, directly and without intermediate steps, toward the printing area to a position at which the second inkjet head is positioned opposite the maintenance head cap and cleaning the second inkjet head by discharging ink droplets from the second inkjet head;

subsequently and without intermediate steps, returning the head unit to the home position at which the first inkjet head is opposite the maintenance head cap, and cleaning the first inkjet head by discharging ink droplets from the first inkjet head.

* * * * *